US006925713B1

(12) United States Patent
Kanemitsu et al.

(10) Patent No.: US 6,925,713 B1
(45) Date of Patent: Aug. 9, 2005

(54) METHOD OF MANUFACTURING AN ANNULAR MEMBER MADE FROM A METAL SHEET HAVING A PERIPHERAL WALL

(75) Inventors: Toshiaki Kanemitsu, Kobe (JP); Kunihiro Harada, Miki (JP); Naoki Fujii, Kobe (JP)

(73) Assignee: Kabushiki Kaisha Kanemitsu, Akashi (JP)

( * ) Notice: Subject to any disclaimer, the term of this patent is extended or adjusted under 35 U.S.C. 154(b) by 0 days.

(21) Appl. No.: 09/157,318

(22) Filed: Sep. 21, 1998

(30) Foreign Application Priority Data

Oct. 6, 1997 (JP) ..... 9-272676

(51) Int. Cl.[7] ..... B21K 1/42

(52) U.S. Cl. ..... 29/892.2; 29/892.11; 29/892.3; 29/892; 72/68

(58) Field of Search ..... 29/892, 892.11, 29/892.2, 892.32; 72/68, 110

(56) References Cited

U.S. PATENT DOCUMENTS 3,700,382 A * 10/1972 Pacak
4,749,375 A * 6/1988 Guevel et al.
5,113,584 A * 5/1992 Wenzel ..... 29/892
5,237,745 A * 8/1993 Yamanaka ..... 72/68 X
5,396,787 A * 3/1995 Kanemitsu et al. .. 29/893.32 X
5,440,796 A * 8/1995 Deggau et al. ..... 29/892.2 X
5,699,689 A * 12/1997 Yamanaka ..... 72/68
5,737,955 A * 4/1998 Ohya et al.

* cited by examiner

*Primary Examiner*—Eric Compton
(74) *Attorney, Agent, or Firm*—Bacon & Thomas

(57) ABSTRACT

The present invention relates to a disc-shaped material made from metal sheet, provided for the manufacture of a pulley or the like. According to the present invention, even if the metal sheet is thin and light weight, a peripheral wall of sufficient strength can be formed, by the following steps: rotating the material held between a pair of dies and pressing an outer periphery of the material by means of a forming roller, in a radially inward direction, thereby thickening axially the outer periphery of the material to be extended to both sides of a non-processed portion, thus forming the peripheral wall.

8 Claims, 10 Drawing Sheets

METHOD OF MANUFACTURING AN ANNULAR MEMBER MADE FROM A METAL SHEET HAVING A PERIPHERAL WALL

BACKGROUND OF THE INVENTION

1. Field of the Invention

The present invention relates to a method of manufacturing an annular member made from a metal sheet used for a pulley or the like, particularly, an annular member made from a metal sheet having a peripheral wall, the peripheral wall has a shape of protruding to either side of a plate-like base portion surrounded by the peripheral wall.

2. Description of the Prior Art

A conventional method of manufacturing this kind of annular member made from a metal sheet, is schematically shown in FIGS. 13 to 15. According to the manufacturing method, a disc-shaped material 1 made from a metal sheet, having a predetermined thickness T3 shown in FIG. 13, is employed thereby manufacturing the member. In other words, the material 1 is held between a pair of dies, not shown in the Figures, thereby rotating the material 1 with the dies, while, against an axial center portion of an outer periphery of the material 1 as shown in FIG. 14, a roller 2 for splitting the outer periphery of the material is pressed to split the outer periphery of the material in a forked state, thereby forming a split portion 3. As shown in FIG. 15, against the split portion 3, a forming roller 4 is pressed, thus forming a peripheral wall 6 protruded on both sides of a non-processed portion 5.

According to the conventional manufacturing method described in FIGS. 13 to 15, the outer periphery of the material 1 is split, thereby forming the split portion 3 which is axially extended to form the peripheral wall 6. As a result, a thickness T3 of the disc-shaped material 1 made of the metal sheet is required to be at least 2 or more times the thickness required to make the peripheral wall 6. In other words, it is required to employ the thick material 1 before forming the peripheral wall 6 of the determined thickness T4, and the thickness T3 of the non-processed portion 5 has the same measurements as the thickness T3 of the original material 1 whereby there is a problem wherein it is difficult to achieve a light weight produced annular member.

Moreover, it is difficult for the thickness T4 of the peripheral wall 6 to be finished so as to be larger than the thickness T3 of the non-processed portion 5. In order to finish it as mentioned above, there has been a problem wherein a thickness disposal of the peripheral wall in a post step must be additionally conducted.

SUMMARY OF THE INVENTION

The present invention addresses the above mentioned problems and circumstances. According to the present invention, a thin disc-shaped material made of a metal sheet is employed to make it possible to form a peripheral wall. Accordingly, an object of the present invention is to provide a manufacturing method for the annular member made of a metal sheet, having the peripheral wall, easily leading to a light weight annular member being produced.

In addition, another object of the present invention is to provide a manufacturing method for an annular member made of a metal sheet, having a peripheral wall, which can make the peripheral wall thinner or thicker than a non-processed portion.

A method of manufacturing an annular member made from a metal sheet having a peripheral wall according to the present invention, comprises the steps of:

rotating a disc-shaped material made of a metal sheet, pressing an outer periphery of the metal sheet material in a radially inward direction, while continuing to rotate the metal sheet material, thickening the outer periphery axially by pressing it, the metal sheet material then also defining a non-processed portion, protruding the outer periphery to either side of the non-processed portion of the metal sheet material, and forming a peripheral wall protruding to either side of the non-processed portion.

The present invention is not a method wherein an outer periphery of the metal sheet material is split before it is developed, thereby forming the peripheral wall, but a method wherein the outer periphery thereof is axially thickened while extending it to both sides of the non-processed portion of metal sheet material, thus forming the peripheral wall. Accordingly, even if the metal sheet material is too thin to be split, the outer periphery of the metal sheet material can be formed as a peripheral wall protruded to both sides of the non-processed portion. Additionally, there is formed a peripheral wall having a thickness corresponding to a radial width of the outer periphery of the metal sheet material formed as the peripheral wall. Consequently, a width thereof is appropriately predetermined, thereby easily making it possible to make the peripheral wall thicker or thinner. As a result, it is also possible to thicken the peripheral wall more than the non-processed portion.

According to the present invention, in an intermediate phase of the step of thickening the outer periphery of the metal sheet material axially, a preliminary peripheral wall may be formed so that the outer periphery thereof may have an axial center portion which is more outwardly protrusive than both axial ends, in an arc-shaped state. Thus, the outer periphery of the metal sheet material is formed as the preliminary peripheral wall shaped as mentioned above, before forming it as the peripheral wall protruding to both of the non-processed portion. As a result, all steps from an initial forming step to a finishing step of finishing the outer periphery of the metal sheet material into the peripheral wall thereof can be unforcedly conducted.

Moreover, according to the present invention, in advance of forming the preliminary peripheral wall, the outer periphery of the metal sheet material may be formed so that a sectional face thereof may have a substantially circular shape. Thus, the outer periphery of the metal sheet material is formed so that the sectional face thereof may have a substantially circular shape, before it is formed as the preliminary peripheral wall having the above shape. Thereafter, the peripheral wall protruding to both sides of the non-processed portion is formed by stages, thereby enabling the steps from the initial forming step to the finishing step of finishing the outer periphery thereof into the peripheral wall thereof to be further unforcedly conducted. Herein, the above expression of "a sectional face thereof may have a substantially circular shape" includes cases wherein a sectional shape is an exact circle, a shell-shaped circle, and a distorted circle.

Moreover, preferably, the present invention adopts a method comprising the steps of:

holding the non-processed portion of the metal sheet material between a pair of dies, rotating the metal sheet material with the dies, pressing a forming surface of a forming roller against the outer periphery of the metal sheet material, and rotating the forming roller together with the metal sheet material. In this case, the steps of forming the annular member having the peripheral wall disc-shaped metal sheet material made can be unforcedly conducted.

Furthermore, preferably, the present invention includes a finishing step of finishing the preliminary peripheral wall protruding to either side of the non-processed portion, in a predetermined shape.

In case of adopting the manufacturing method, the preliminary peripheral wall can be finished so as to lead to the peripheral wall having an optional shape. As a result, for example, the outer peripheral surface of the peripheral wall can be finished so as to be axially flat or axially curved in an arc-shape, or a flange can protruded to both axial ends of the peripheral wall, or a poly-V-groove can be formed on the outer peripheral surface of the peripheral wall.

Other features and effects of the present invention are further clarified by embodiments described below.

DETAILED DESCRIPTION OF THE PREFERRED EMBODIMENTS

Figure 1A:
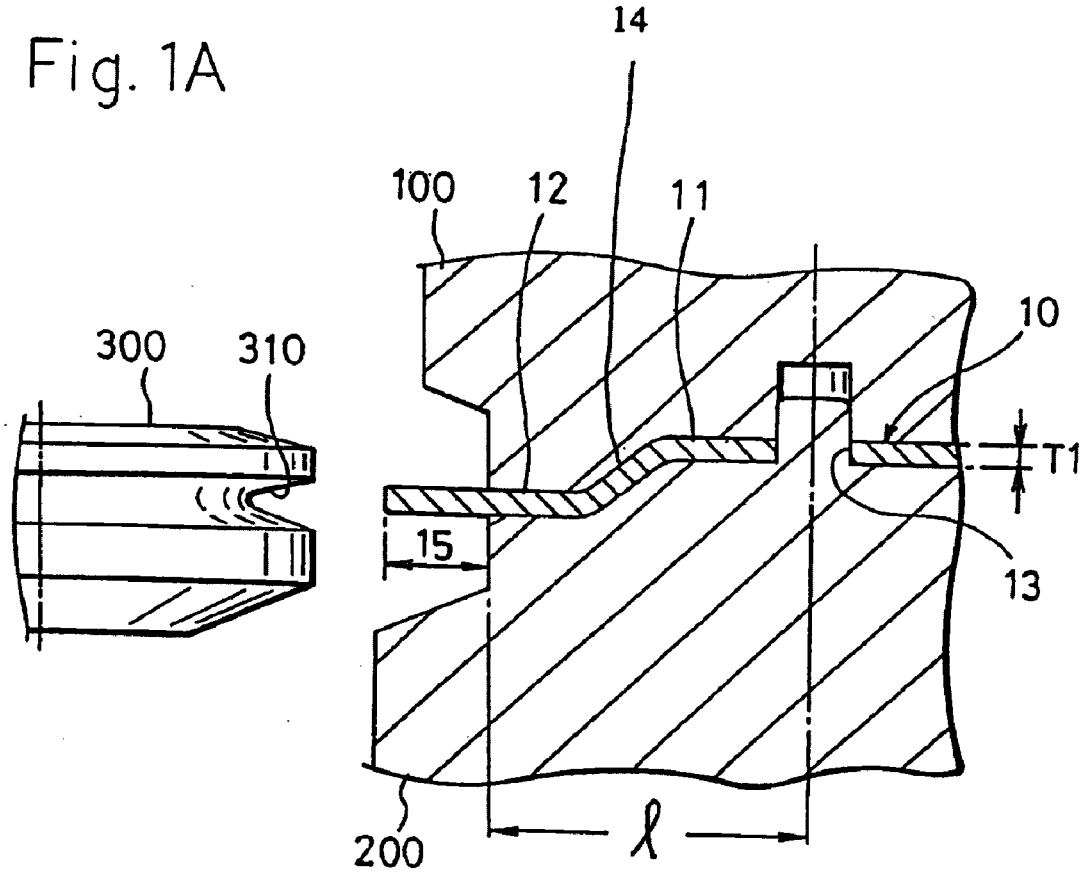
FIGS. 1A and 1B are diagrams showing the formation of a chevron portion.
Figure 1B:
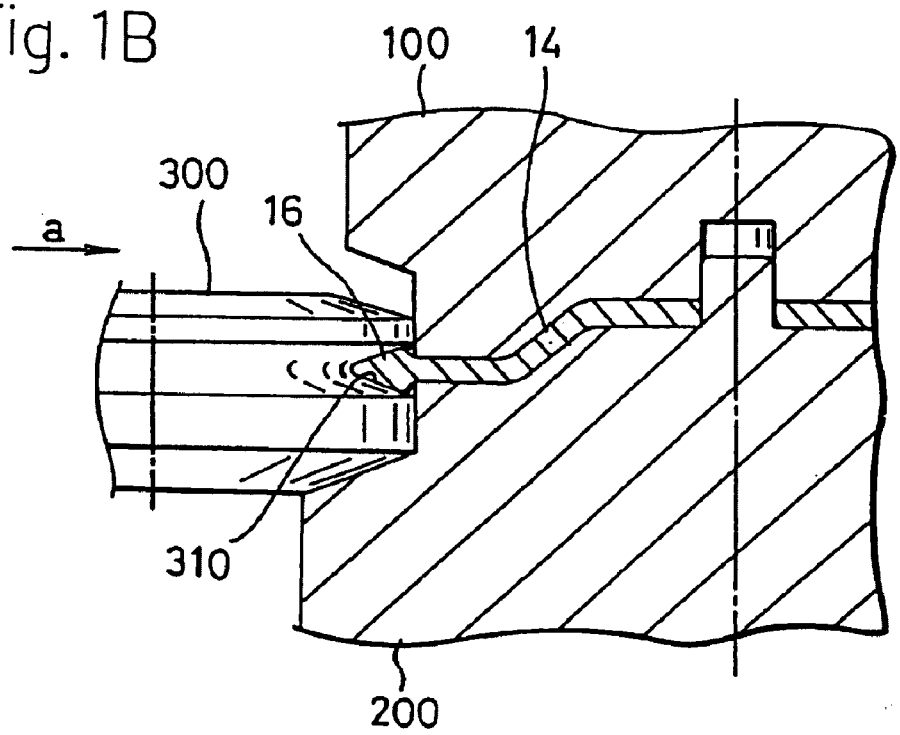

Referring now to the drawing, a preferred embodiment of the present invention is described below.

FIGS. 1 to 5 are diagrams showing each step of the embodiment of a manufacturing method according to the present invention.

FIGS. 6 to 10 are diagrams showing a section of the outer periphery of the metal sheet material formed by each step.

In this embodiment, a disc-shaped material 10 made of metal sheet is previously subject to a drawing process, whereby as shown in FIG. 1A, a swelling portion 11 having a circular shape and a flange portion 12 around it are concentrically disposed. A center of the swelling portion 11 having the circular shape is provided with a round hole 13 formed by piercing. The round hole 13 can be employed as a fixing hole for fixing it on a shaft of a rotary rod or the like.

As shown in FIG. 1A, in the disk-shaped material 10 made of a metal sheet, the inner portion including the swelling portion 11, the stepped portion 14, flange portion 12 is referred to a non-processed or stepped portion 1. A process for forming a peripheral wall 21 (see FIG. 5B) is applied to an outer periphery 15 on an outside of the non-processed portion 1. A radial width of the outer periphery 15 is appropriately predetermined, taking an axial length and a thickness of the peripheral wall 21 (see FIG. 5B) to be formed into consideration.

As shown in FIG. 1A, the non-processed portion 1 of the metal sheet material 10 is held between a pair of dies or an upper die 100 and a lower die 200 and the dies 100, 200 are rotated, thereby rotating the metal sheet material 10 with the dies 100 and 200. The dies 100 and 200 are employed in common through all steps shown in FIGS. 1 to 5. Additionally, a shape and a thickness T1 of the non-processed portion 1 of the metal sheet material 10 are not substantially changed by conducting the whole steps.

Figure 6:
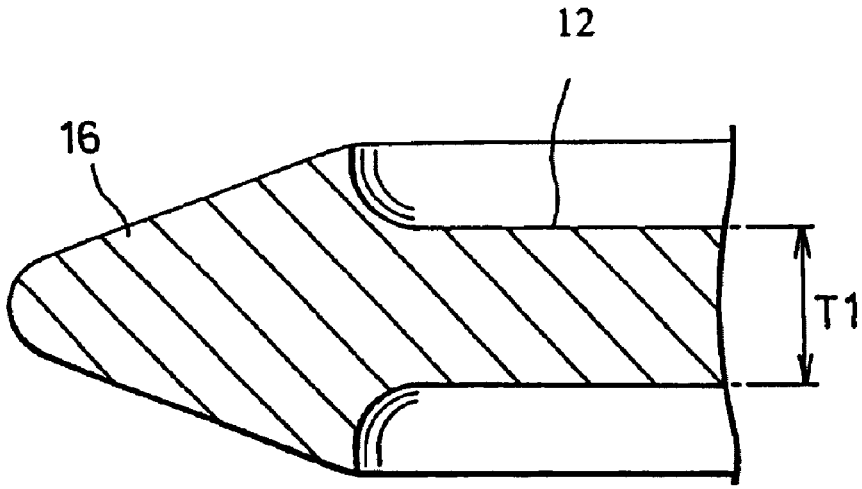
FIG. 6 is an enlarged sectional view of the chevron portion.

As shown in FIG. 1A, a first forming roller 300 is disposed to be opposed to the outer periphery 15 of the material metal sheet 10 held between the pair of dies 100, 200. A valley-shaped forming surface 310 expanded outwardly and included in the first forming roller 300 is moved radially from outside to the outer periphery 15. As shown by arrow "a" in FIG. 1B, the first forming roller 300 is advanced, thereby pressing the outer periphery 15 of the metal sheet material 10 in a radially inward direction by means of the valley-shaped forming surface 310 (see FIG. 1A). Thereafter, the first forming roller 300 is rotated together with the metal sheet material 10, the outer periphery 15 is radially reduced in rotation while it is axially thickened, with the result that shape having the same shaped outline as the valley-shaped forming surface 310 is formed. Namely, a sectional chevron shape having a round top as enlarged and shown in FIG. 6 is formed. A chevron portion 16 having such a shape is annularly disposed around it so as to extend to either side of the non-processed portion 1, or flange portion 12 shown in FIG. 6.

Figure 2A:
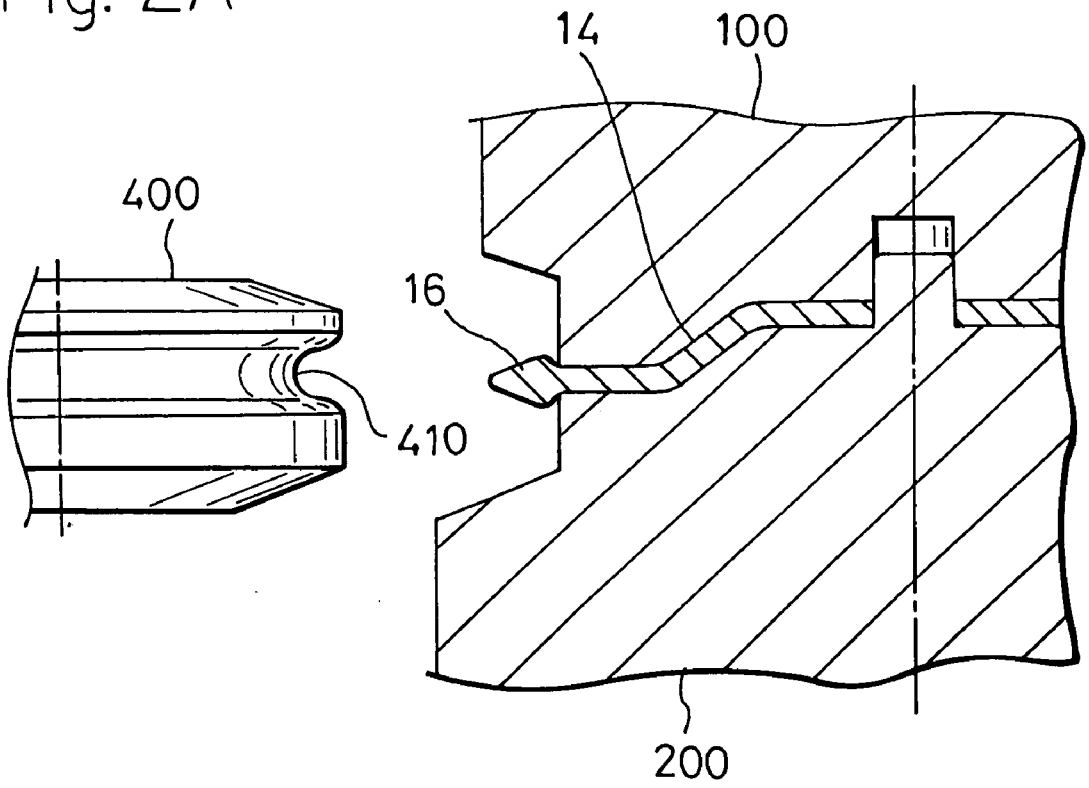
FIGS. 2A and 2B are diagrams showing the formation of a substantially circular portion.
Figure 2B:
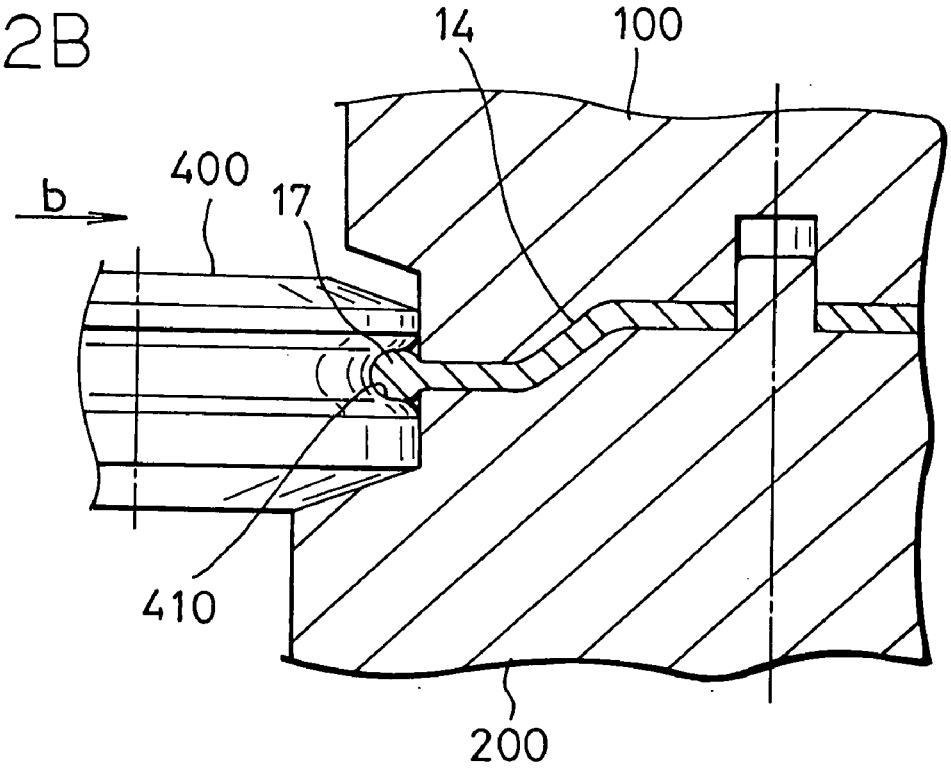
Figure 7:
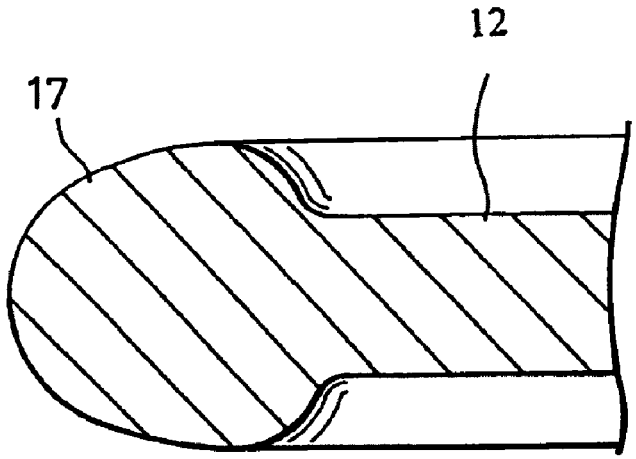
FIG. 7 is an enlarged sectional view of the substantially circular portion.

In a next step, as shown in FIG. 2A, a second forming roller 400 is disposed to be opposed to the chevron portion 16. A semi-circular forming surface 410 disposed on the second forming roller 400 is moved from radially outside to the chevron portion 16. As shown by an arrow "b" in FIG. 2B, the second forming roller 400 is advanced, thereby pressing the chevron portion 16 (see FIG. 2A) in a radially inward direction, on the semi-circular forming surface 410. Thereafter, the second forming roller 400 is rotated together therewith, whereby the chevron portion 16 is radially reduced in rotation while it is axially thickened, a shape having the same shaped outline as the semi-circular forming surface 410 is formed so that a sectional face thereof may have a substantially circular shape as enlarged and shown in FIG. 7. The substantially circular portion 17 formed as mentioned above is annularly disposed around the non-processed portion 1 so as to protrude to both sides of the non-processed portion 1. The section of the substantially circular portion 16 may be exactly circular or shell-shaped though the shape of the substantially circular portion 17 in FIG. 7 is distorted.

Figure 3A:
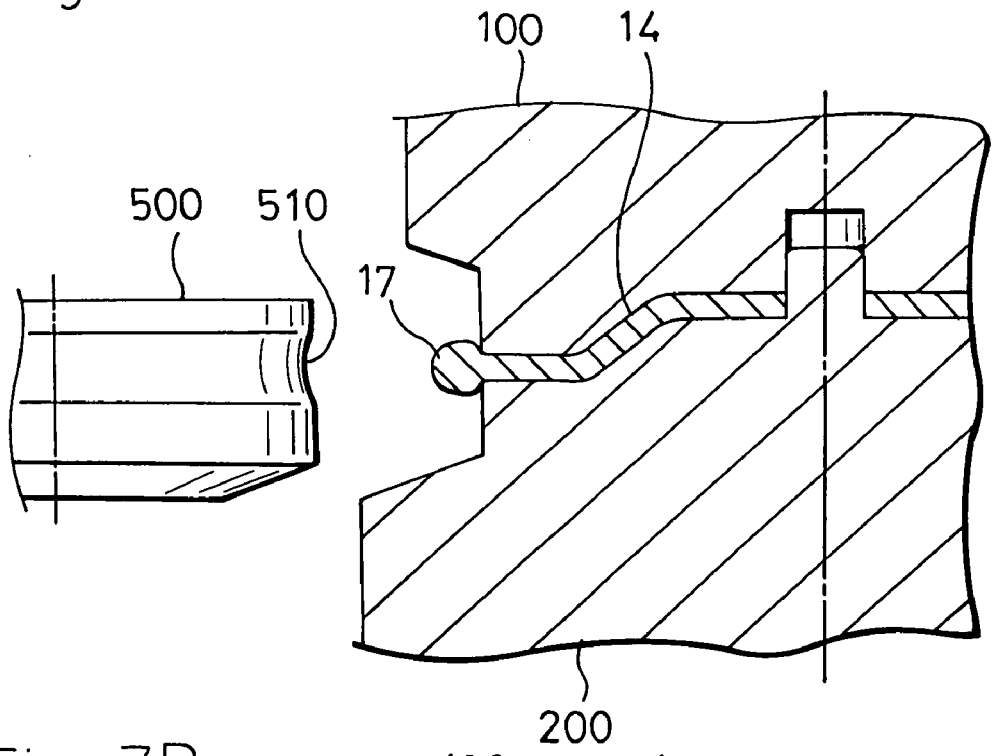
FIGS. 3A and 3B are diagrams showing the formation of a preliminary peripheral wall.
Figure 8:
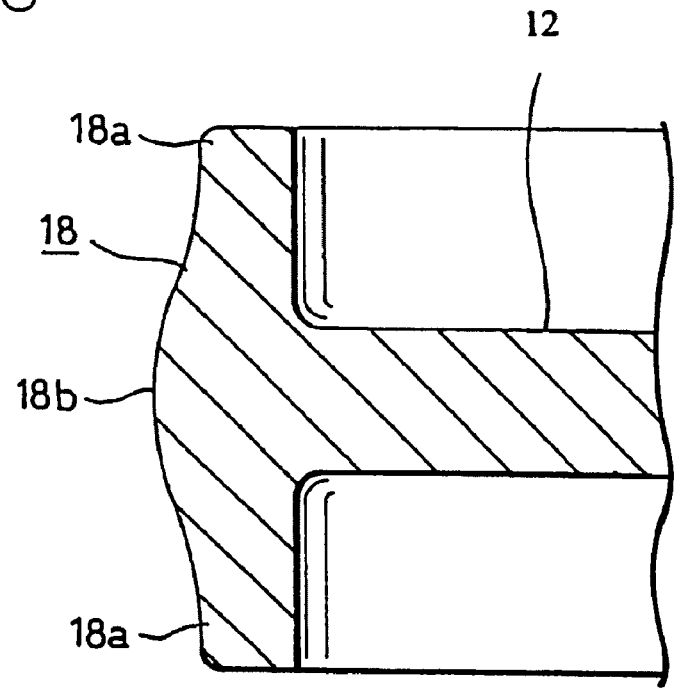
FIG. 8 is an enlarged sectional view of the preliminary peripheral wall.
Figure 9:
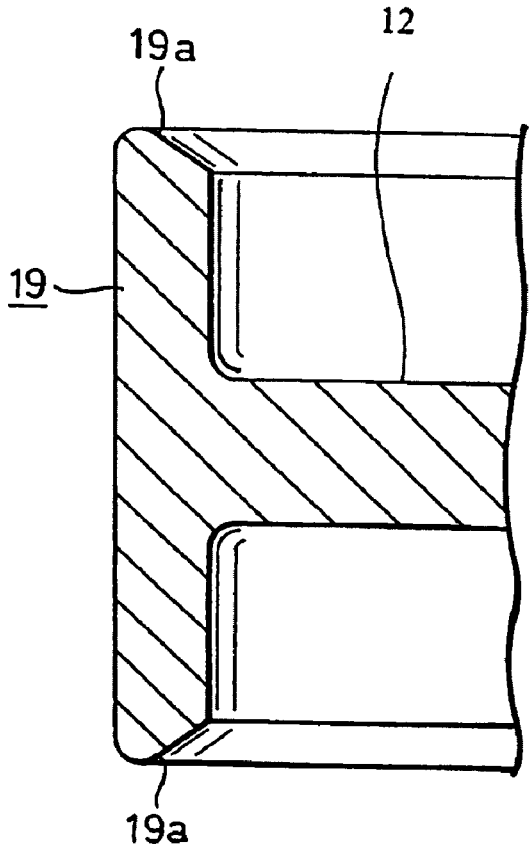
FIG. 9 is an enlarged sectional view of the rough peripheral wall.

In a next step, as shown in FIG. 3A, a third forming roller 500 is disposed so as to be opposed to a substantially circular portion 17, a shallow concave forming surface 510 included in the third forming roller 500 is moved from radially outside to the substantially circular portion 17. As shown by an arrow "c" in FIG. 3B, the third forming roller 500 is advanced, the substantially circular portion 17 (see FIG. 3A) is pressed to a radially inward direction, by means of the concave forming surface 510, the third forming roller 500 is rotated together, the substantially circular portion 17 is radially reduced in rotation while it is axially thickened, with the result that a shape having the same shaped outline as the concave forming surface 510 is formed as a sectional preliminary peripheral wall 18 as enlarged and shown in FIG. 8. The preliminary peripheral wall 18 having such a shape is annularly disposed around it so as to extend to either side of the flanged portion 12 of the non-processed portion 1. The preliminary peripheral wall 18 as illustrated in FIG. 8 is provided with flat portions 18*a*, 18*a* on the both ends in an axial direction, a swelling portion 18*b* having a small height is disposed on an axial central portion, which is situated more outwardly than the flat portions 18*a*, 18*a*, and the swelling portion 18*b* has a great curvature so as to swell in an arc-shape. The outer peripheral surface of the each flat portion 18*a* and the outer peripheral surface of the swelling portion 18*b* are smoothly continuous.

Figure 4A:
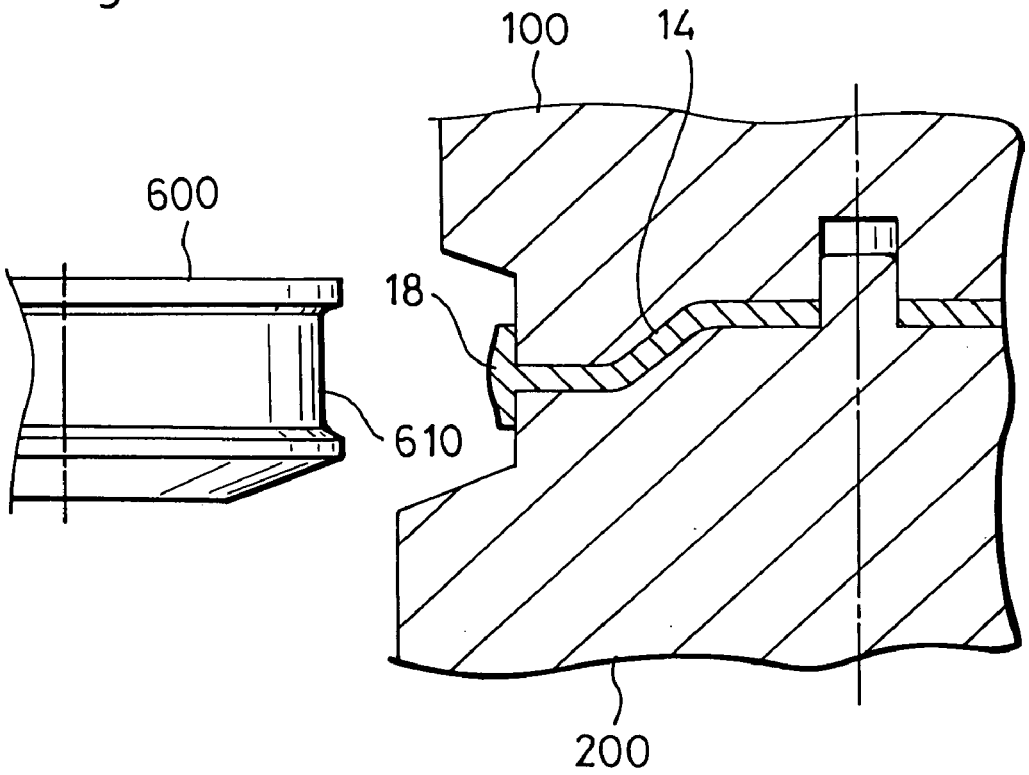
FIGS. 4A and 4B are diagrams showing the formation of a rough wall.

In a next step, as shown in FIG. 4A, a fourth forming roller 600 is disposed to be opposed to the preliminary peripheral wall 18, a groove-shaped forming surface 610 included in the fourth forming roller 600, whose bottom surface is flat and shallow, is moved from radially outside to the preliminary peripheral wall 18. As shown by an arrow "d" in FIG. 4B, the fourth forming roller 600 is advanced, the preliminary peripheral wall 18 (see FIG. 4A) is pressed in a radially inward direction on the groove-shaped forming surface 610, thereby rotating the fourth forming roller 600 therewith, and mainly the swelling portion 18*b* (see FIG. 8) of the preliminary peripheral wall 18 is radially reduced in rotation, while, a whole of the preliminary peripheral wall 18 is slightly axially thickened. Consequently, a shape having the same shaped outline as the groove-shaped forming surface 610 is formed as a sectional rough peripheral wall 19 as enlarged and shown in FIG. 9, the rough peripheral wall portion 19 having such a shape is annularly disposed around it so as to extend to either side of the non-processed portion 1. As illustrated in the figure, the rough peripheral wall 19 is not yet well-finished because the shape of the end surfaces 19*a*, 19*a* of the axial both ends is rounded.

Figure 5A:
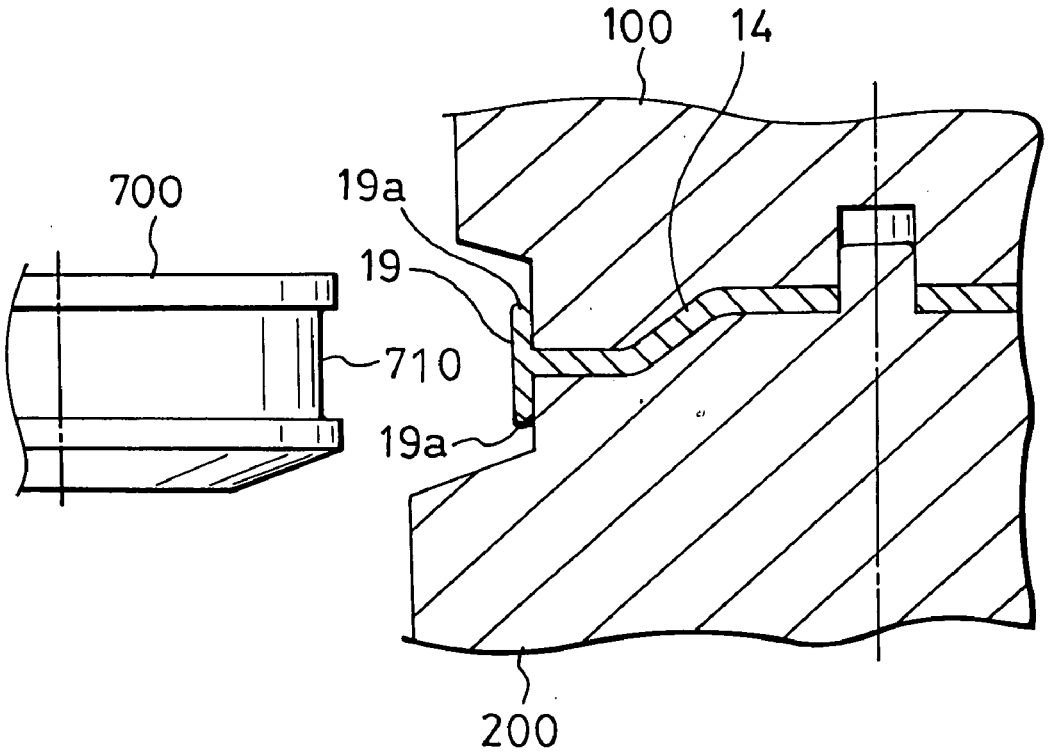
FIGS. 5A and 5B are diagrams showing the formation of a peripheral wall (i.e., a finishing step).

In a next step, as shown in FIG. 5A, a fifth forming roller 700 is disposed so as to be opposed to the rough peripheral wall 19, a groove-shaped forming surface 710 included in the fifth forming roller 700, whose bottom surface is flat and shallow, is moved from radially outside to the preliminary peripheral wall 19. The groove-shaped forming surface 710 has a shape enabling the end surfaces 19*a*, 19*a* of the rough peripheral wall 19 shown in FIG. 9 to be finished accurately, for example, a shape enabling the end surfaces 19*a*, 19*a* to be exactly shaped. As shown by an arrow "e" in FIG. 5B, the fifth forming roller 700 is advanced, the rough peripheral wall 19 (see FIG. 5A) is pressed in a radially inward direction on the groove-shaped forming surface 710, the fifth forming roller 700 is rotated together therewith, mainly the end surfaces 19*a*, 19*a* of the axial both edges of the rough peripheral wall 19 are formed in rotation so as to make a right angle with the outer peripheral surface, which are formed as the peripheral wall 21 having the same shaped outline as the groove-shaped forming surface 710. The peripheral wall 21 formed in such a manner, is annularly disposed around it, so as to protrude to either side of the non-processed portion 1. The peripheral wall 21 formed in this manner has both end surfaces which are exactly shaped as enlarged and shown in FIG. 10. The peripheral wall 21 is equally protruded to either side of the non-processed portion 1. The outer peripheral surface thereof is axially flat. A thickness T2 and an axial length of the peripheral wall 21 shown in FIG. 10 have each size fitted in a radial width of the outer periphery 15 of the original material 10.

Figure 3B:
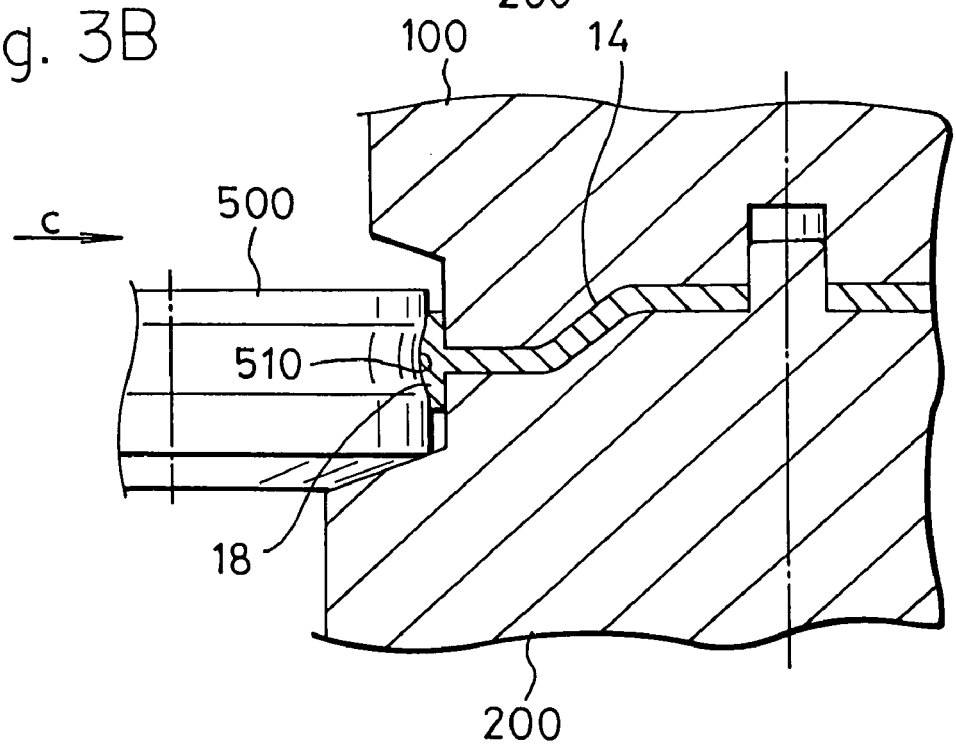
Figure 4B:
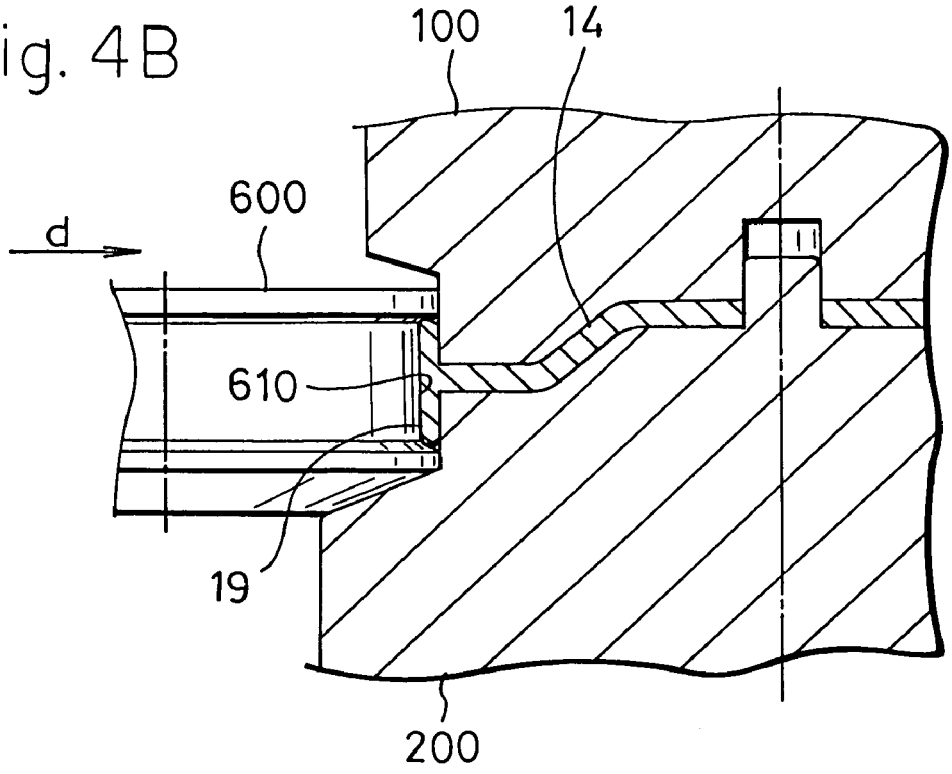
Figure 5B:
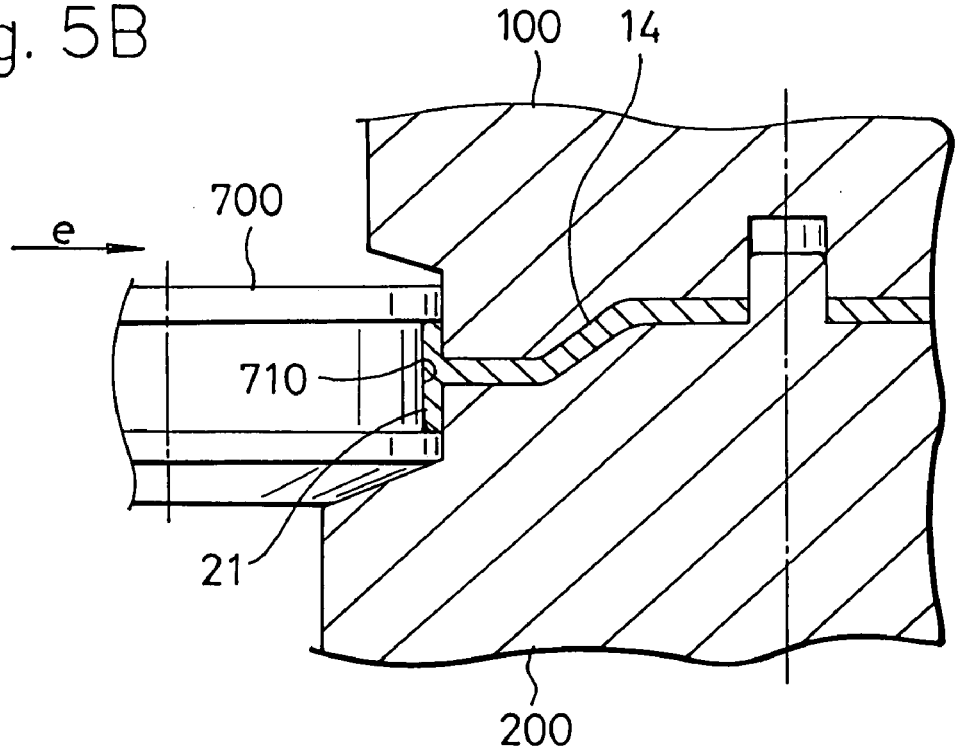

According to the manufacturing method mentioned above, the rough peripheral wall 19 formed in the step of FIG. 4B, is finished by the finishing step of FIG. 5B, leading to the peripheral wall 21 having high accuracy. Before the preliminary peripheral wall 18 formed in the step of FIG. 3B is finished leading to the peripheral wall 21, a step of forming the rough peripheral wall 19 is interposed. Also, the finishing step may be conducted immediately after the preliminary peripheral wall 18 is formed, thereby forming the peripheral wall 21. As the case may be, after a state wherein the non-processed portion 1 of the material 10 as shown in FIG. 1A is held between the pair of dies 100, 200, a step wherein the preliminary peripheral wall 18 is directly formed on the outer periphery 15 may be conducted. Alternatively, a step of forming directly the substantially circular portion 17 and a step of forming a preliminary peripheral wall 18 may be subsequently conducted. Additionally, there is also a case wherein a step of forming directly the peripheral wall 21 is conducted.

In the finishing step mentioned above, the peripheral wall 21 having both axial end surfaces which are exactly shaped, is formed. However, the shape of the forming surface of the forming roller is changed, whereby it is also possible to form the peripheral wall 21 having the outer peripheral surface extended in an arc shape as shown in FIG. 11, or form the peripheral wall 21 including the flanges 22, 22 protruded outwardly on the both ends in the axial direction as shown in FIG. 12.

Figure 10:
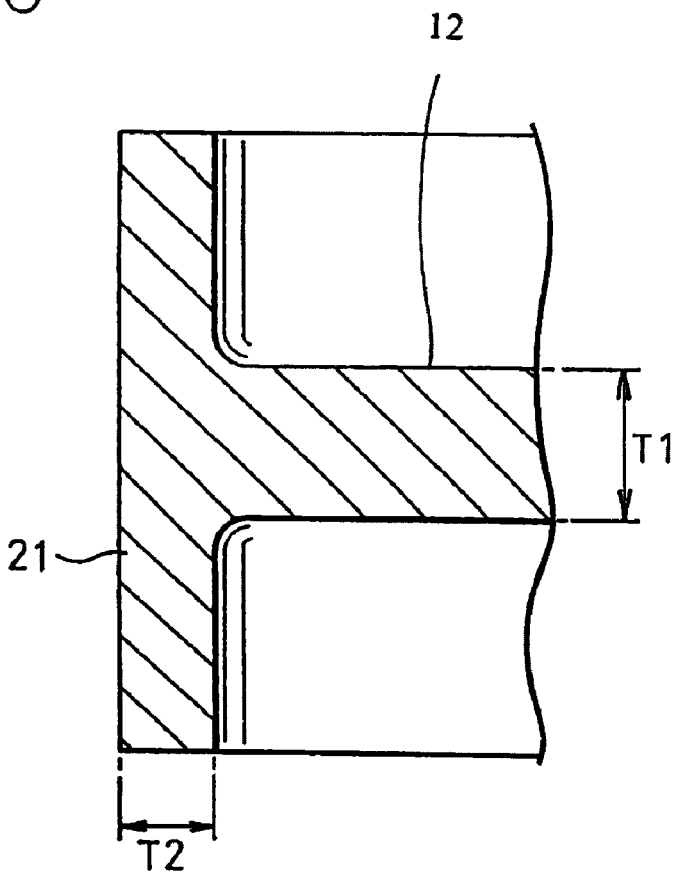
FIG. 10 is an enlarged sectional view of the peripheral wall.
Figure 11:
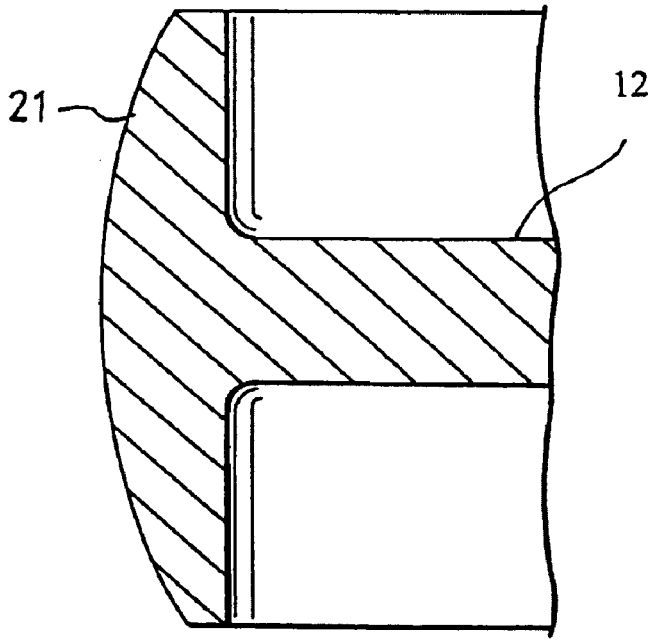
FIG. 11 is an enlarged sectional view of a peripheral wall according to a modification.
Figure 12:
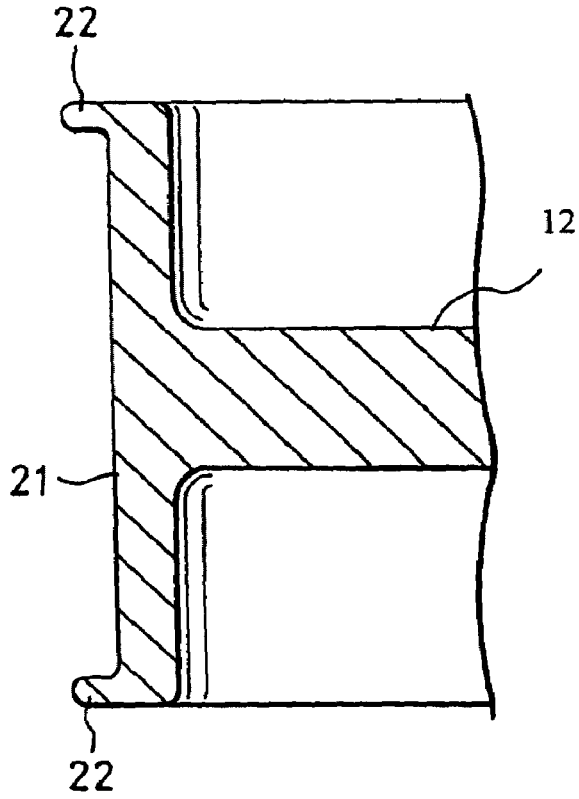
FIG. 12 is an enlarged sectional view of a peripheral wall according to another modification.
Figure 13:
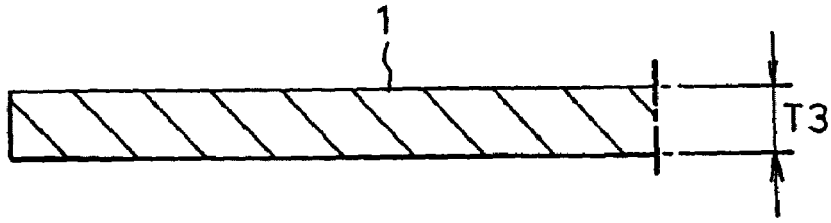
Fig. 13 (PRIOR ART)
FIG. 13 is a partially sectional view of a metal sheet material employed in a conventional method.
Figure 14:
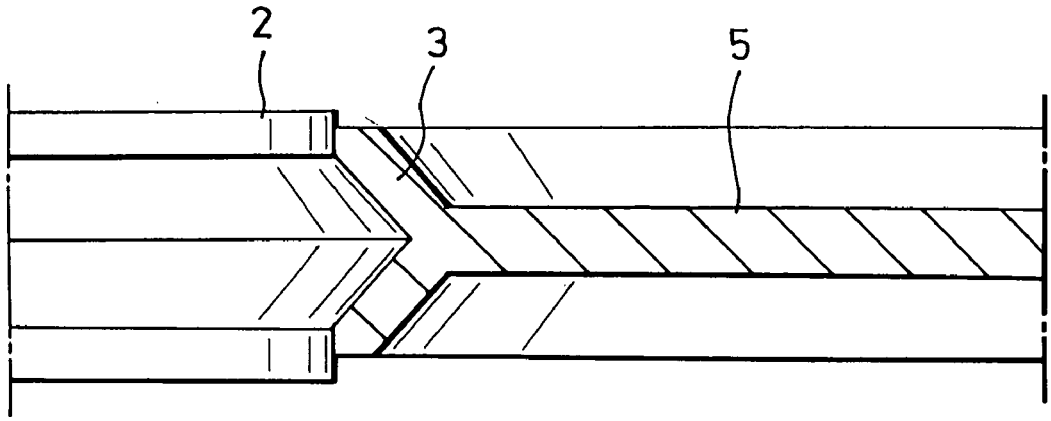
Fig. 14 (PRIOR ART)
FIG. 14 is a diagram of a slitting step of slitting the metal sheet material, according to the conventional method.
Figure 15:
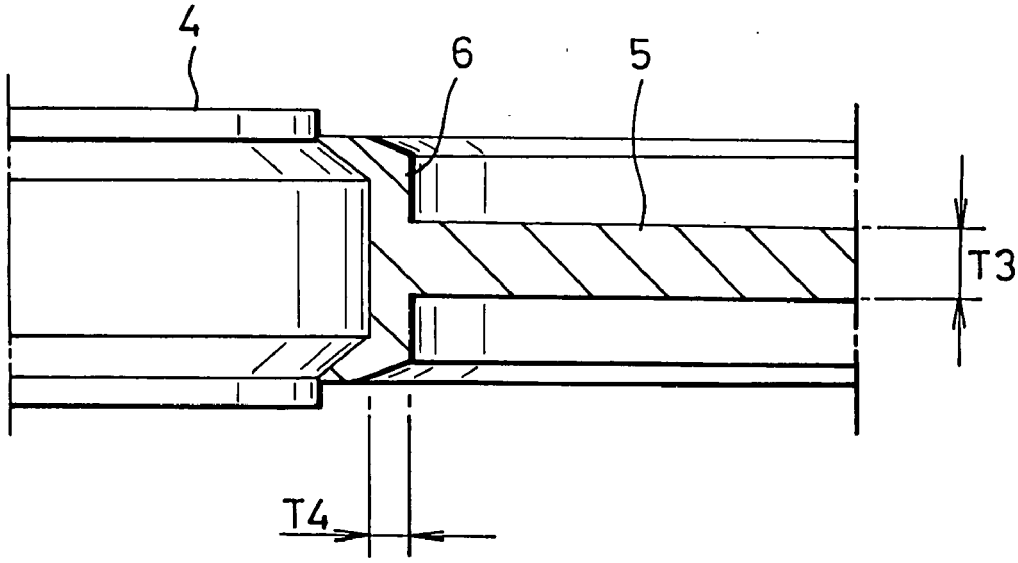
Fig. 15 (PRIOR ART)
FIG. 15 is a diagram showing the formation of a peripheral wall according to the conventional method.

The annular member having the sectional-shaped peripheral wall 21 shown in FIGS. 10, 11 and 12 can be employed as a back side pulley for winding a flat belt. Moreover, though it is not shown in figures, a poly-V-groove may be disposed on the outer peripheral surface of the peripheral wall 21 in the finishing step. The annular member manufactured in such a way, may be employed as the poly-V-groove pulley for winding the poly-V-belt.

As mentioned above, not only in the case that the disc-shaped material made of the metal sheet is originally thick, but also in the case that the material is too thin to be split, the above manufacturing method makes it possible to form a peripheral wall having a necessary thickness, thereby having the effect of facilitating the lightweight production of the annular member. Moreover, regardless of the thickness of the non-processed portion, a remarkable effect of enabling the peripheral wall to be formed in a state of a desirable thickness can be achieved. Therefore, a back surface pulley for supporting a back surface of a belt, a pulley with a flange, a pole piece V-groove pulley or the like having light weight can be easily manufactured.

What is claimed is:

1. A method of manufacturing an annular member from a disc-shaped metal sheet material defining an outer periphery, comprising the steps of:

forming the disc-shaped metal sheet to have a non-processed portion including the outer periphery and a stepped portion defined by an inclined wall, and an inner swelling portion connected to the outer periphery by the stepped portion, the outer periphery and the swelling portion lying in different planes;

rotating the disc-shaped metal material;

pressing the outer periphery of the metal sheet material in a radially inward direction, while continuing to rotate the metal sheet material;

thickening the outer periphery axially and without buckling by said pressing;

protruding the outer periphery to either side of the non-processed portion of the metal sheet material; and forming a peripheral wall protruding to either side of the non-processed portion.

2. The method of manufacturing an annular member according to claim 1, wherein, in an intermediate phase of the step of thickening the outer periphery of the metal sheet material axially, a preliminary peripheral wall is formed so that the outer periphery may have an axial center portion which is more outwardly swelled than both axial ends, so as to be arc-shaped.

3. The method of manufacturing an annular member according to claim 2, wherein, in advance of forming the preliminary peripheral wall, the outer periphery of the metal sheet material is formed so that a sectional face thereof may have a substantially circular shape.

4. The method of manufacturing an annular member according to claim 1, further comprising the steps of:

holding the non-processed portion of the metal sheet material between a pair of dies;

producing said rotation of the metal sheet material with the dies;

producing said pressing by a forming surface of a forming roller against the outer periphery of the metal sheet material; and rotating the forming roller together with the metal sheet material.

5. The method of manufacturing an annular member according to claim 4, wherein, in an intermediate phase of the step of thickening the outer periphery of the metal sheet material axially, a preliminary peripheral wall is formed so that the outer periphery may have an axial center portion which is more outwardly swelled than both axial ends, so as to be arc-shaped.

6. The method of manufacturing an annular member according to claim 5, further comprising the step of: finishing the preliminary peripheral wall protruding the either side of the non-processed portion in a predetermined shape.

7. The method of manufacturing an annular member according to claim 1, wherein the stepped portion is formed before said pressing step.

8. The method of manufacturing an annular member from a disc-shaped metal sheet material as defined in claim 1, the disc-shaped metal sheet defining an axis of symmetry, the method further comprising the step of:

extending the swelling portion to the axis of symmetry.

* * * * *